US005498194A

United States Patent [19]

Altier

[11] Patent Number: 5,498,194

[45] Date of Patent: Mar. 12, 1996

[54] STUFFED DOLL FORMED FROM A SINGLE SOCK

[76] Inventor: Sandra Altier, 7140 S. Thomas, Bridgeview, Ill. 60455

[21] Appl. No.: 309,651

[22] Filed: Sep. 21, 1994

[51] Int. Cl.[6] ..... A63H 3/02

[52] U.S. Cl. ..... 446/369

[58] Field of Search ..... 446/369, 370, 446/371, 372, 378, 385, 387, 390

[56] References Cited

U.S. PATENT DOCUMENTS

| | | | |
|---|---|---|---|
| 1,292,789 | 1/1919 | Jack | 446/369 |
| 1,308,432 | 7/1919 | Lochridge | 446/369 |
| 1,489,685 | 4/1924 | Anderson | 446/369 |
| 1,554,712 | 9/1925 | Clark | 446/369 |
| 1,692,897 | 11/1928 | Howard et al. | 446/369 |
| 1,698,653 | 1/1929 | Poole | 446/369 X |
| 2,347,405 | 4/1944 | Ford | 446/369 |

FOREIGN PATENT DOCUMENTS

| | | | |
|---|---|---|---|
| 2202835 | 7/1973 | Germany | 446/369 |
| 3242360 | 5/1984 | Germany | 446/370 |
| 274886 | 4/1951 | Switzerland | 446/369 |
| 179263 | 4/1922 | United Kingdom | 446/371 |

*Primary Examiner*—Robert A. Hafer
*Assistant Examiner*—D. Neal Muir
*Attorney, Agent, or Firm*—Paul H. Gallagher

[57] ABSTRACT

The skin of the stuffed doll is taken from a single sock. The toe of the sock is cut off, and the upper part of the leg portion is cut off, and the resulting lower portion forms the skin of the head, body and legs of the doll. Another piece of the sock cut off at the top forms the skin of the arms of the doll, the arms being sewn to the body. A cincture is used for shaping the head. A hat and a dress may be included if desired.

2 Claims, 3 Drawing Sheets

STUFFED DOLL FORMED FROM A SINGLE SOCK

BRIEF SUMMARY OF THE INVENTION

The stuffed doll of the invention is made up of a skin with stuffing therein, and includes a body and head. It may be provided with a hat or cap and a form of dress.

The skin of the doll is taken from a sock, and from a single sock, while the other features, such as the hat and dress may be taken from other sources, and it is stuffed with suitable stuffing.

A main object of the invention is to provide a stuffed doll of unusual and simple design, using in its main construction the parts of a single sock, cut and sewn in a novel manner as to provide a simple means and manner of forming the doll.

Another object of the invention is to provide such a doll that by a novel method of sewing and stitching parts of the skin, the finished body of the doll sits in an upright position.

An additional object is to provide such a doll of which a major portion of the resulting skin of the doll is made from a single piece or part of the sock, thereby preventing its mutilation, or making it extremely difficult to mutilate it. Other parts that are not made from the single piece of skin, are of rigid and tight construction, and effectively secured to the trunk of the doll, thereby making it difficult to mutilate those parts as well.

A still further object is to provide such a stuffed doll that can be easily further embellished by a cap and a suit, and by having a face painted thereon. The entire doll, including the skin, the stuffing, and the added parts and paint is non toxic and is readily washable.

BRIEF DESCRIPTION OF THE VARIOUS FIGURES OF THE DRAWINGS

DETAILED DESCRIPTION

Figure 1:
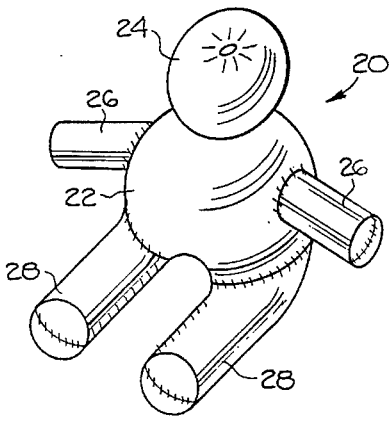
FIG. 1 is a perspective view of a doll made according to the present invention, without a hat or dress.

Referring in detail to the drawings, FIG. 1 shows a doll 20 which is complete in itself, but this figure does not include a hat that may be desired or a suit that may be put on the doll. The doll shown in FIG. 1 is a complete structural item, which constitutes the main portion of the doll. The doll as shown in this figure includes a trunk 22, head 24, arms 26, and legs 28.

References are made in this description of various elements which may be in a group identified as a whole, but also at times identified individually from others of that group. Those in a group may be identified generically with a single reference numeral and individual ones of those elements identified with the same reference numeral with postscript letters. The directions right, left, front, back, will be identified with the corresponding generic reference numerals, with the letters r, 1, f, b, to indicate those individual elements or directions as referred to.

Figure 2:
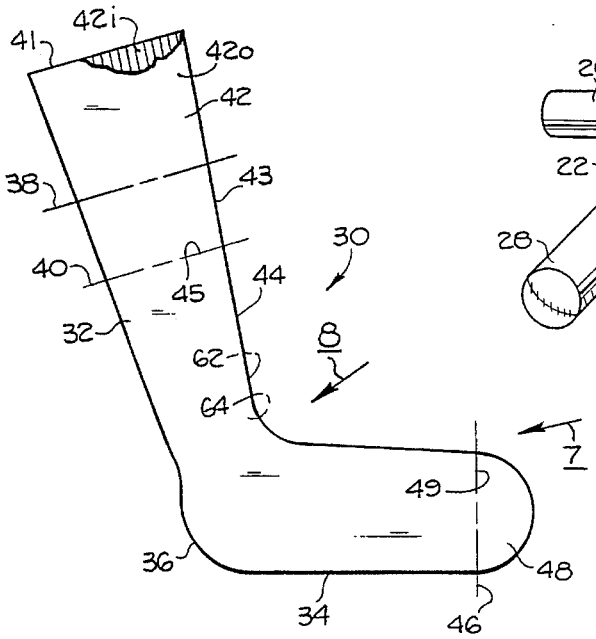
FIG. 2 is a side view of the sock from which pieces are cut to form the skin of the doll.

FIG. 2 shows a conventional sock 30 which constitutes a single sock from which parts or pieces form the skin of the doll. The sock includes a leg portion 32, a foot portion 34, and a heel portion 36. The leg portion is cut crosswise at lines 38, 40 forming pieces 42, 43, 44. The top piece 42 is utilized as described hereinbelow but the piece 43 is not used, and discarded. Upon removal of the pieces 42, 43, the remainder of the leg portion is referred to as an ankle portion 44, this portion having an open upper end 45. Another line 46 is cut across the foot portion, cutting off the toe piece 48, which also is not used and becomes waste, the foot portion then having a lower open end 49. It is mentioned that the sock is tubular, according to its own character, and this tubular form is utilized in fabricating the doll, particularly in stuffing the parts.

Those retained portions of the sock are utilized in forming the skin of the doll, and briefly, the large, integral portion of the sock, including the parts 34, 36, 44 form the head, trunk, and legs, while the top piece 42 is cut to form the arms 26. For convenience, the following discussion treats the formation of the arms, before discussion of the main portion of the body.

Figure 3:
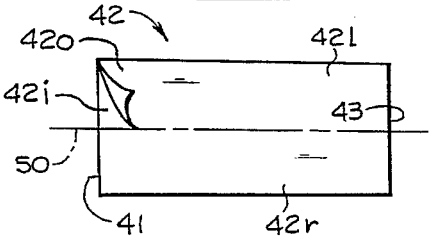
FIG. 3 is a face view of a piece cut from the sock.
Figure 4:
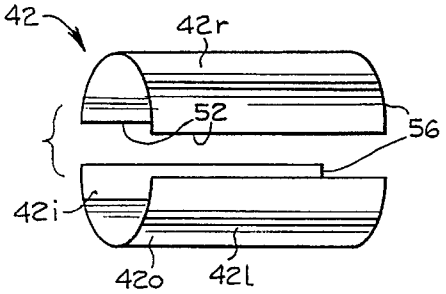
FIG. 4 is a view of the two parts resulting from cutting the part of FIG. 3.
Figure 5:
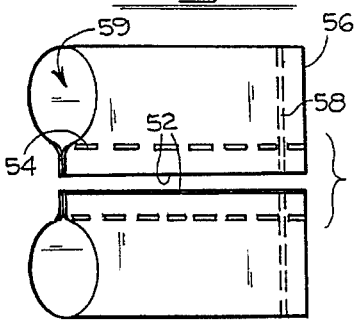
FIG. 5 represents the pieces of FIG. 4 after a stitching step.

The piece 42 from the top of the sock is shown in FIG. 3. It is laid flat, in double form, and cut along a central longitudinal line 50, forming two parts or pieces, 42*r*, 42*l*. For further convenience in identifying the elements, the piece 42 (FIGS. 2, 3) has an outer surface 42*o* and an inner surface 42*i*. After cutting the main piece 42 along the line 50, the two smaller pieces 42*r*, 42*l* are positioned as shown in FIG. 4, juxtaposed as illustrated for convenience, these two pieces having side edges 52. The side edge portions of each piece are stitched together as indicated at 54 (FIG. 5), and at one end, the edges 56 are stitched together at 58, forming in each case, a tube closed at one end and open at the other end, at 59.

Figure 6:
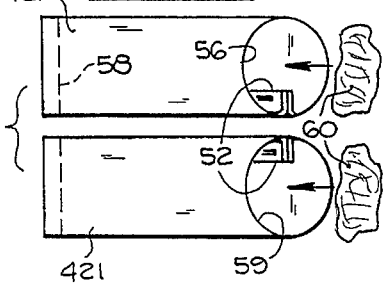
FIG. 6 is a view showing the pieces of FIG. 5, but turned inside out, and indicating the step of putting stuffing into the pieces.

The pieces 42*r* 42*l* are then inverted, or turned inside out, with the stitching on the inside. Then these members are stuffed with stuffing 60 (FIG. 6) of a kind referred to hereinbelow, to a full tight stuffed condition. These pieces, so stuffed, form the arms 26 of the doll, and they are applied to the trunk of the body as described hereinbelow. All parts of the doll are stuffed to a condition that they are rigid and stiff, and normally relatively inflexible.

After removing the piece 42, and forming the arms thereof, the remainder of the sock that has not been cut away, which includes the portions 32, 34, 36 is then utilized for forming the legs, trunk, and head of the main structure of the doll. As used herein, the term main structure includes the doll without a hat or suit.

Figure 8:
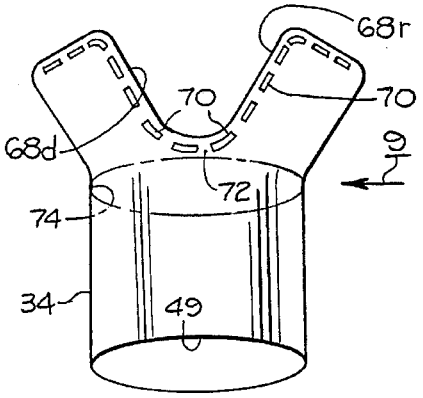
FIG. 8 is a view oriented generally according to FIG. 7 but showing elements of the skin after being cut and stitched.

For the steps in forming the main structure of the doll, attention is directed to FIGS. 8–16. In FIG. 8, the article or item being worked on is positioned at about a 90° angle relative to FIG. 2, and viewed generally in the direction of the arrow 8 in the latter figure. In this position, (FIG. 8), the foot part 34 is disposed vertically, with its open edge 49 directed downwardly. The upper portion shown in FIG. 8, the legs, is constituted by the part 44 of the sock (FIG. 2) which is the ankle portion of the sock.

Figure 7:
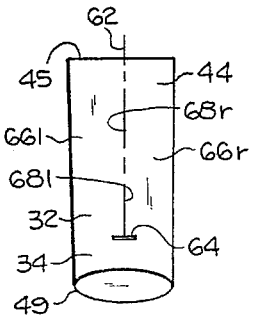
FIG. 7 is a view of the sock of FIG. 2 taken approximately in the direction of the arrow 7 in FIG. 2.

As a preliminary step in forming the legs 28 of the body, the sock is positioned as represented in FIG. 7 in which the ankle portion 44 is laid flat, in double form, and in that form, it is cut along the longitudinal line 62 from the open end edge 45 (see also FIG. 2) down to a point 64 which is at a location higher than the heel in the sock. This cutting (at 62) forms two lengths 66*r*, 66*l*, which form the corresponding legs 28 of the doll. These lengths or parts have inner edges 68*r*68*l*, which are also seen in FIG. 8.

Then these lengths 66 are stitched along their inner edges, 68*r*, 68*l*, as shown at 70 (FIG. 8), this stitching continuing and extending across the crotch 72 of the body. This stitching and the resulting stuffing, push the legs into a diverging position as viewed in FIG. 8.

In certain of the views, the positioning or orientation is reversed, such as right and left, in the different figures, because the parts are relatively inverted.

Figure 9:
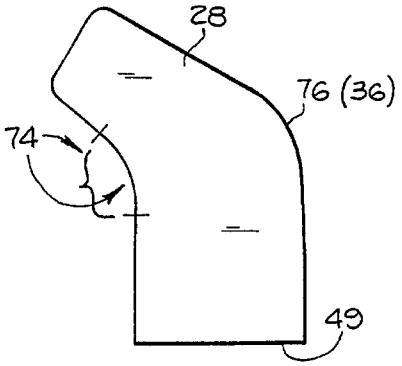
FIG. 9 is a view taken in the direction of arrow 9 at FIG. 8.
Figure 10:
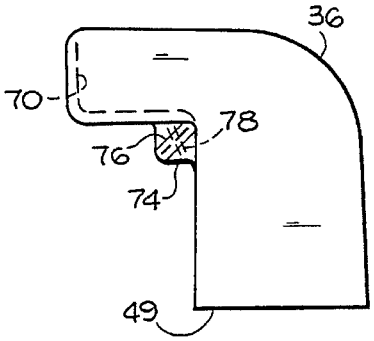
FIG. 10 is a view of the part shown in FIG. 9 showing material to be stitched and formed into a tuck.

After performing the stitching step indicated at 70, a tuck is taken, as indicated at 74 (FIGS. 8–10), in the skin, at the juncture of the legs with the trunk. The heel portion 36 (FIG. 2) becomes the seat or rump of the doll, now identified 76. Because of the original shape of the sock, the trunk and legs of the doll assume a first angular relation as indicated in FIG. 9, in which they are at a relatively obtuse or broad angle, but in order to form an angle of approximately 90° at this location so that the doll will sit up straight in its eventual construction, the tuck 74 is made. To form this tuck, the skin at the juncture of the legs and trunk, at the inside corner, is gripped and pulled out as so indicated (FIG. 10), which pulls the legs up into an angle adjacent 90° degrees relative to the trunk. This material forming the tuck is then pressed into a flat position or fold, as shown in dotted lines 76 in FIG. 10, and stitched as indicated at 78. The stitching 70 (FIG. 8) is also shown in FIG. 10. This results in effectively shortening the skin, at the front and the top of the legs, to pull the legs into the sharper angle mentioned. The flattened fold 76 is laid against the body of the doll (FIG. 11) but when the completed skin is turned inside out, as referred to below, all the seams become smooth and inconspicuous.

Figure 11:
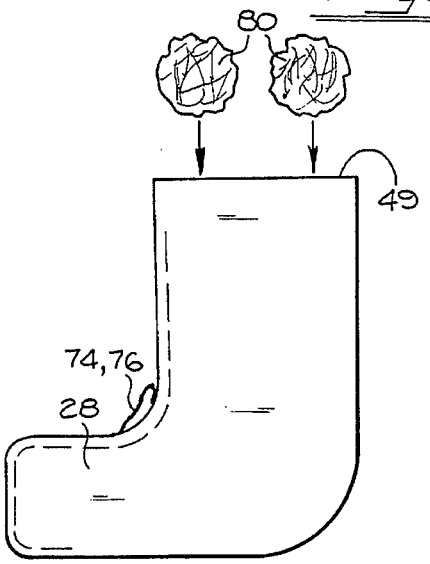
FIG. 11 shows the part of FIG. 10 after being turned inside out, and indicating stuffing to be inserted therein.

The item, which includes the trunk and legs, is then turned inside out or inverted, with these seams on the inside. It is then stuffed tight with stuffing 80, filling the entire skin. It is pointed out that at this stage, the head is not yet formed, but is to be formed later, and the upper edge 49 of the item, illustrated in FIG. 11 is formed by the edge 45 of the sock (FIG. 2).

Figure 12:
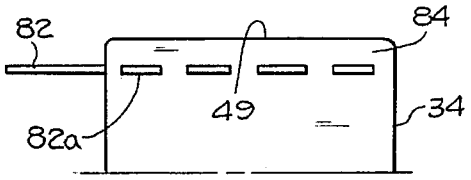
FIG. 12 is a view of the upper part of FIG. 11 with a pull string inserted therein.
Figure 13:
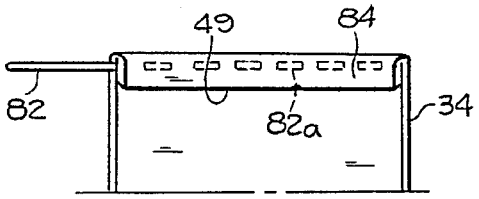
FIG. 13 is a view of the part shown in FIG. 12, but from the inside thereof and after the marginal portion is tucked inside.
Figure 14:
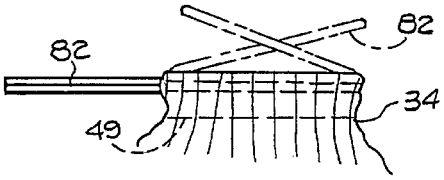
FIG. 14 is a view oriented in the direction of FIG. 13, but showing the upper part of the skin after it is drawn up by the pull string.
Figure 15:
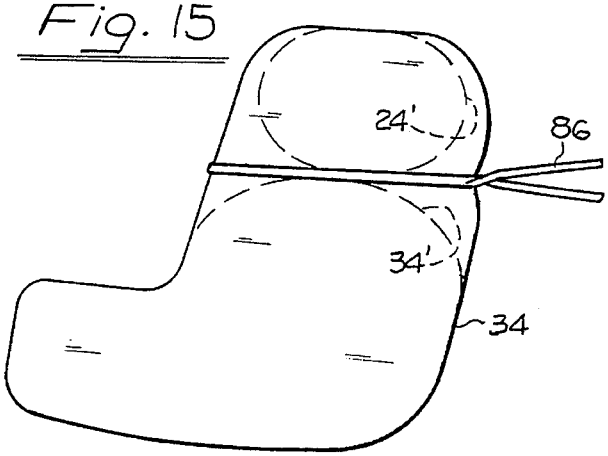
FIG. 15 is a view of the doll from the right of FIG. 1 but without the arms secured thereto, and indicating a step in forming the head.

Following the above, a step is taken to close the upper end (FIG. 11) as shown in FIGS. 12–14. A pull cord 82 is stitched through the material of the sock as indicated at 82*a*, leaving an end portion 84 above the pull cord, which is then at the open end of the skin, which is formed by the foot portion 34 (FIG. 2).

It will be recalled that at this point the skin is stuffed tight with stuffing. The end portion 84 is then turned inwardly (FIG. 13), and the pull cord 82 is pulled up tight and tied, this tying being exerted against the stuffing within the item. The outer end portions of the pull cord are then pushed or pried into the interior to form a closed end (FIG. 1) at the top of the item. The amount of stuffing used, and the degree to which the upper open end of the skin is pulled tight are effective for forming a rounded, and effectively spherical shape, at the top of the sock. The inturned edge portions 84 of the pull cord remain confined in the interior, presenting a relatively smooth outer surface at the top of the head.

Following the foregoing steps, the head 24 is formed. This is done by utilizing a second pull cord or cincture 86 (FIG. 15) placing it around the stuffed item, which is formed by the segment 34 of the sock. This pull cord is so placed at a predetermined location, and is then pulled up tight and tied, pulling the skin inwardly to a great extent, as indicated at 34', 24' and then tied. In this position, the pull cord is nearly invisible, and forms a head that is for the most part substantially spherical in shape. The portion of the body, below the head, constituting the trunk of the body, is also spherical in shape at its upper end. The skin on the trunk, head, and legs is a continuous single piece, as it was in the sock. This distinctive shape, including the effective separation of the head and trunk, is produced from a portion of the sock that is nearly or substantially cylindrical, not varying greatly in diameter in its original condition.

Figure 16:
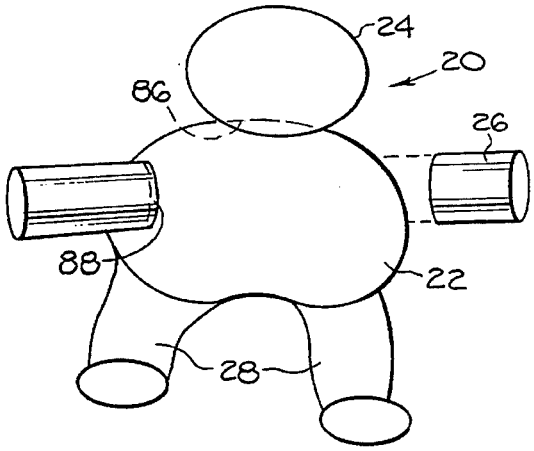
FIG. 16 is a front view taken from the left of FIG. 15, after the head is formed, and with the arms in position to be attached.
Figure 17:
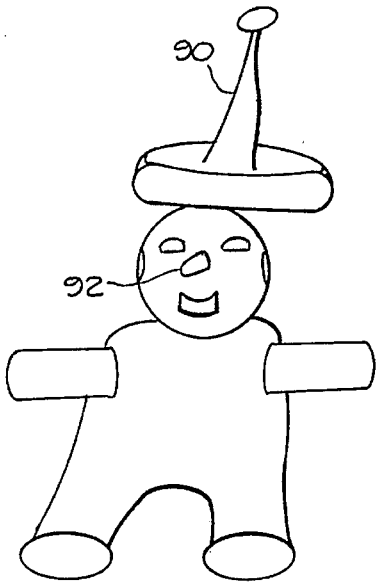
FIG. 17 is a front view of the doll with a hat or cap secured thereto.
Figure 18:
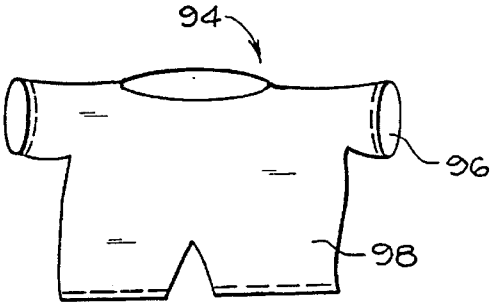
FIG. 18 is a front view of a suit that may be applied to the doll.

After the foregoing, the arms 26 are applied. The pieces making up the arms, and the steps in fabricating them, are illustrated in FIGS. 3–6 and described above. These items, now arms, as referred to above, are open at one end and they are applied to the trunk with their open ends fitted to the trunk and sewed thereto as indicated at 88 (FIG. 16). This stitching fixes the arms to the body very securely, and because of their stuffed condition, and the shape of the trunk, the arms extend outwardly, at an angle corresponding to the position of their securement to the trunk, which as desired may be generally outwardly and slightly forwardly.

The foregoing, as indicated above, constitutes the construction of the doll as a construction proper, and may be referred to as the main construction. A clown's hat, or similar hat or cap as shown at 90, of any suitable kind, may be utilized by sewing it directly to the skin of the doll, on the top of the head. This hat or cap also may be stuffed and may be of any desired shape, but it is an item separate from the doll proper or main construction of the doll.

If desired, a face 92 may be painted on the head, with non toxic paint.

Also, if desired a suit 94 may be put on the doll. The suit is made of single flat piece doubled over and provided with arm and leg elements 96, 98 for receiving the arms and legs of the doll. This suit is preferably stitched to the body, and it may be embellished with various formations and decorations.

The stuffing 60, 80 is of any suitable kind, also non-toxic and non allergenic, and for example may be a polyester fiber fill. The doll is washable, washing not affecting any of the materials, either the skin or the stuffing, or the other elements 90, 94, or the paint used.

I claim:

1. A stuffed doll having a head, a trunk, and legs, together having a skin that is continuous and of one piece and made up of a continuous and one piece part of a single sock, the doll including arms with skins that are made up of a piece of the same single sock, and secured to the trunk, the sock including a foot portion with an open toe end, a heel portion, an ankle portion, and a top portion, the skin of the head and the trunk of the doll together being made up of the foot portion and the heel portion together, of the sock, the head of the doll being made up of the foot portion of the sock with the open toe end sewn closed, and the sock including a cincture operable for shaping the stuffed foot portion into the head and trunk, the skin of the legs being made up of respective halves of the ankle portion of the sock on opposite sides of a longitudinal split, but connected to the foot portion, and the foot portion and the ankle portion, of the sock, are disposed at an angle therebetween of greater than 90°, and the doll includes a tuck therein at the juncture of the foot portion and the ankle portion at the inside angle therebetween, made up of an element of the skin of the sock, that is extended into the inside angle and securement of that element to the skin of the sock at a point displaced from the juncture, resulting in foreshortening the skin from the front of the trunk to the legs and consequently pulling the skin and thereby reducing said angle to approximately 90° and producing a more upright position in the sitting attitude of the doll.

2. A stuffed doll according to claim 1 wherein, the skins of the arms are made up of separated pieces of the top portion of the sock sewn to the skin of the trunk of the doll.

* * * * *